US008950337B1

(12) United States Patent
Davis

(10) Patent No.: US 8,950,337 B1
(45) Date of Patent: Feb. 10, 2015

(54) PERSONAL TRANSPORTATION RAIL SYSTEM

(71) Applicant: William D. Davis, Rolling Hills Estate, CA (US)

(72) Inventor: William D. Davis, Rolling Hills Estate, CA (US)

( * ) Notice: Subject to any disclaimer, the term of this patent is extended or adjusted under 35 U.S.C. 154(b) by 0 days.

(21) Appl. No.: 14/268,828

(22) Filed: May 2, 2014

(51) Int. Cl.
*E01B 25/00* (2006.01)

(52) U.S. Cl.
CPC ..... *E01B 25/00* (2013.01)
USPC ..... 104/130.07; 104/124

(58) Field of Classification Search
USPC ..... 104/27, 89, 112, 124, 130.07
See application file for complete search history.

(56) References Cited

U.S. PATENT DOCUMENTS

| | | | | |
|---|---|---|---|---|
| 105,984 | A | 8/1870 | Sanford | |
| 3,254,608 | A * | 6/1966 | Alden | 104/295 |
| 3,590,743 | A * | 7/1971 | Larson | 104/80 |
| 3,675,584 | A * | 7/1972 | Hall | 104/28 |
| 3,757,699 | A | 9/1973 | Wirth | |
| 5,471,933 | A | 12/1995 | Yoshino et al. | |
| 5,598,783 | A * | 2/1997 | Lund | 104/88.04 |
| 5,738,016 | A * | 4/1998 | Scott | 104/107 |
| 6,263,799 | B1 | 7/2001 | Pardes | |
| 6,401,625 | B1 * | 6/2002 | Henderson | 104/242 |
| 7,302,319 | B2 | 11/2007 | Wu | |
| 7,788,000 | B1 * | 8/2010 | Davis, Jr. | 701/20 |
| 7,921,782 | B2 * | 4/2011 | Keller et al. | 104/89 |
| 8,006,625 | B2 * | 8/2011 | Yang | 104/138.1 |
| 8,146,506 | B2 * | 4/2012 | Stahn | 104/88.01 |
| 2010/0211238 | A1 * | 8/2010 | David, Jr. | 701/20 |

FOREIGN PATENT DOCUMENTS

WO WO 2010/060196 A1 6/2010

OTHER PUBLICATIONS

Morgantown Personal Rapid Transit, Wikipedia.org website.

* cited by examiner

*Primary Examiner* — Zachary Kuhfuss
(74) *Attorney, Agent, or Firm* — Richard C Litman

(57) ABSTRACT

The personal transportation rail system includes an automated, elevated single lane throughway comprising multi-gauge rail track arranged in various combinations. A computerized control system regulates spacing of vehicles while maintaining uniform speed. The rail switching is accomplished by variable gauge rail wheels on the vehicle, which selectively engage or avoid engaging with various wider rail-gauge tracks. On-ramps extend from a guideway station and are taken by the vehicle temporarily engaging with a descending wide-gauge section of track that ends side by side in parallel with the narrow-gauge track. Off-ramps lead into the guideway station as the vehicle engages with the wide-gauge section of throughway track initially in parallel with the narrow-gauge track, the wide-gauge track ascending to remove the vehicle from the main rail line. Bypassing the guideway station involves continuing engagement of the variable gauge wheels with the narrow-gauge track. A level pitch is maintained during climbing and descending.

17 Claims, 20 Drawing Sheets

PERSONAL TRANSPORTATION RAIL SYSTEM

BACKGROUND OF THE INVENTION

1. Field of the Invention

The present invention relates to vehicle traffic systems, and particularly to a personal transportation rail system.

2. Description of the Related Art

There is a need for a unique design for an alternative mode of transportation to supplement our urban and dense population areas' transit systems, which have become grossly overcrowded and inefficient. It would be desirable to have vehicles that are a new form of personal transportation that integrates an additional but separate operating subsystem. Until now there has never been a concept that demonstrates that a practical, viable, economical, guideway/vehicle system can be developed with current state-of-the-art knowledge to improve our personal urban transportation systems. Previous efforts at creating personal rapid transit systems have been based on horizontal switching systems requiring unrealistic real estate for implementation, and none have integrated with an inter-urban transit system. There is a need for a system that utilizes a vehicle that can operate on elevated (grade separated) single lane dedicated guideways, using efficient vertical switching, and with the possibility of moving from an urban rail system to either the street or to an inter-urban high-speed rail system. The guideway mode of operation should be fully automated, electric, safe, and non-polluting, offering vehicle speeds of up to 120 mph. With the worldwide demand for oil, the pollution created by burning fossil fuels, and the inefficiencies created by overcrowded urban streets, we are long overdue for a new system of transportation that can supplement our current system with a much safer, more efficient, electric portal-to-portal system.

Thus, a personal transportation rail system solving the aforementioned problems is desired.

SUMMARY OF THE INVENTION

The personal transportation rail system includes an automated, elevated, single-lane throughway comprising multi-gauge gauge rail track arranged in various combinations. A computerized control system regulates spacing of vehicles, while maintaining uniform speed on the system. The rail switching is accomplished by operation of variable gauge rail wheels on the vehicle, which selectively engage or avoid engaging with the various rail-gauge tracks. All switching track gauges are wider than the main line track gauge. On-ramps extend from a guideway station and are taken by the vehicle, temporarily engaging with a descending wide gauge section of track that ends in parallel with the narrow gauge track.

Off-ramps lead into the guideway station and are taken by the vehicle, engaging with the wide gauge section of throughway track initially in parallel with the narrow gauge track, the narrow gauge track ascending to remove the vehicle from the main rail line. Bypassing the guideway station involves continuing engagement of the variable gauge wheels with the narrow gauge track.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
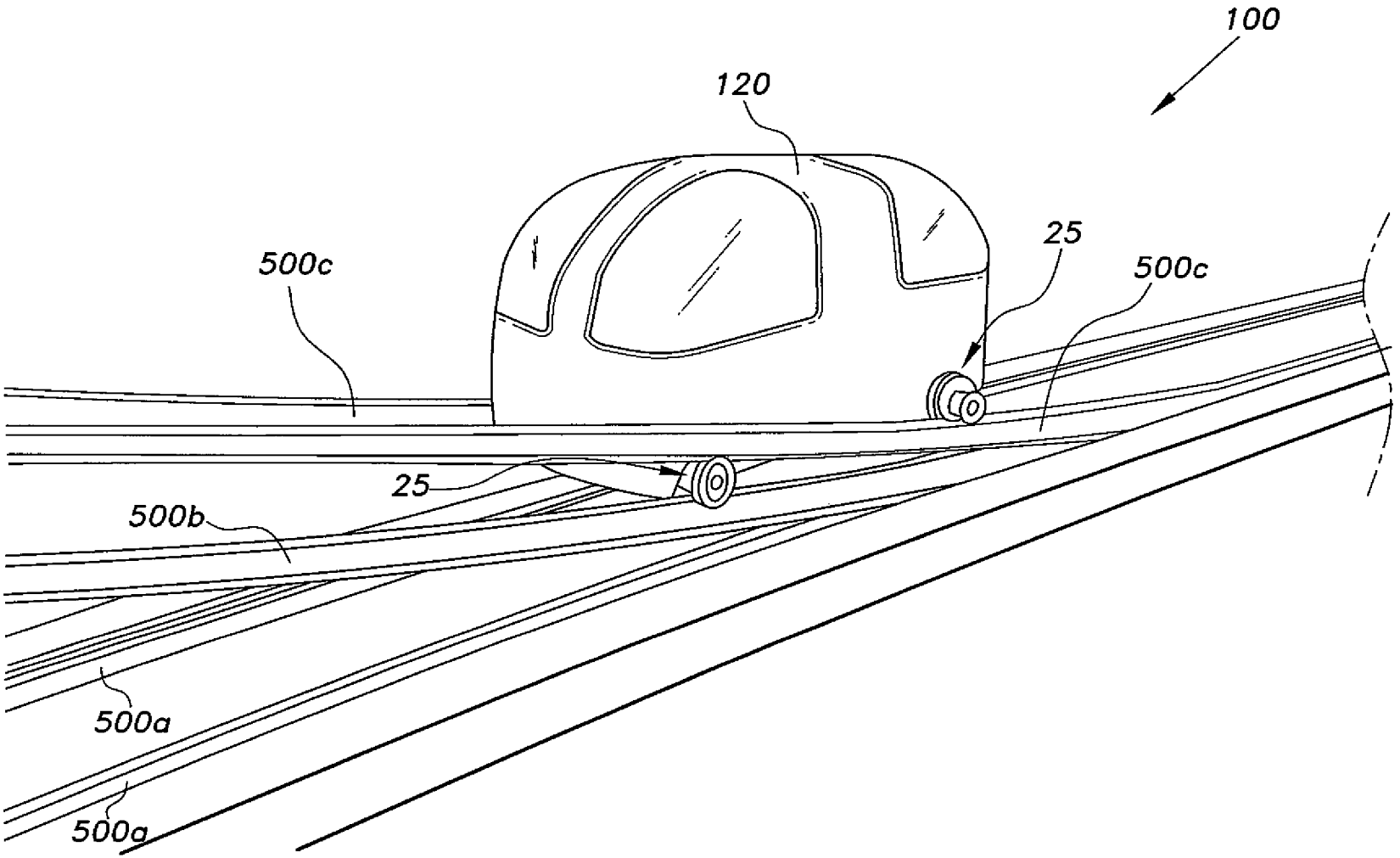
FIG. 1 is an environmental, perspective view of a personal transportation rail system according to the present invention.
Figure 2A:
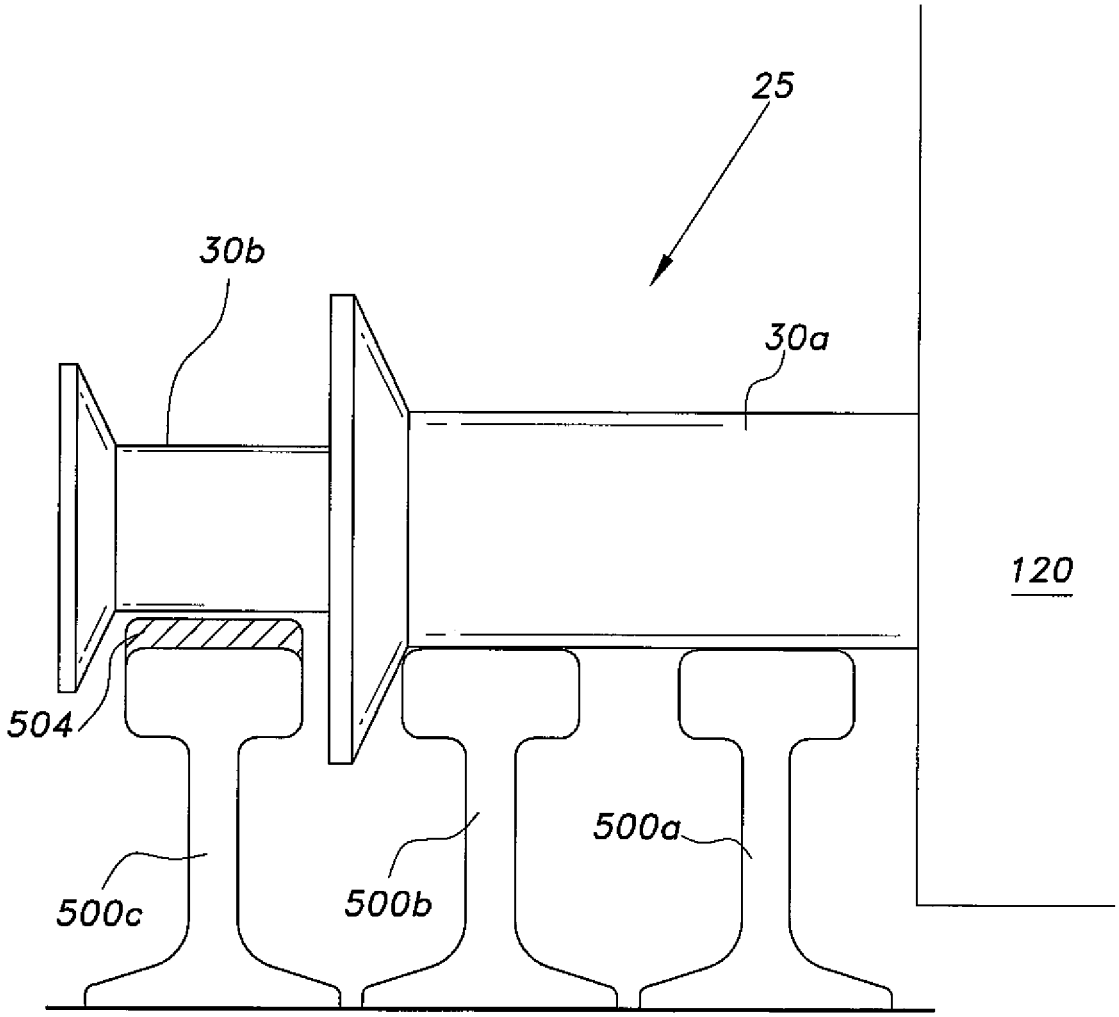
FIG. 2A is a diagrammatic end view showing the wheel extended to the cog rail according to the present invention.

As shown in FIG. 1, the personal transportation rail system 100 includes an automated, elevated single-lane rail guided throughway comprising wide-gauge cog rail 500*c*, intermediate-gauge switch rail 500*b*, and narrow-gauge main rail 500*a* rail arranged in various combinations. A control system regulates spacing of personal transportation rail (PTR) vehicles 120, while maintaining a uniform speed for all vehicles on the system 100. As shown in FIGS. 1 and 2A, vertical rail switching is accomplished by operation of variable gauge rail wheels 25 extending from axles on the vehicle 120 to engage with, or avoid engaging with, a wide gauge track portion 500*c* of the rail guide. The wheels 25 comprise a primary (main) extending wheel 30*a* and a secondary extending (cog) wheel 30*b*.

As shown in FIG. 2A, the fully extended wheel assembly 25 engages cog wheel 30*b* with cog rail 500*c*. A friction surface 504 may be disposed on top portions of the cog rail 500*c* to facilitate traction of the cog wheel 30*b* as it propels the vehicle 120 over the cog rail 500*c*. Cog rail pairs are generally present on entry and exit guideway station platforms 770 to facilitate a vehicle's bypassing the entry or exit.

Figure 2B:
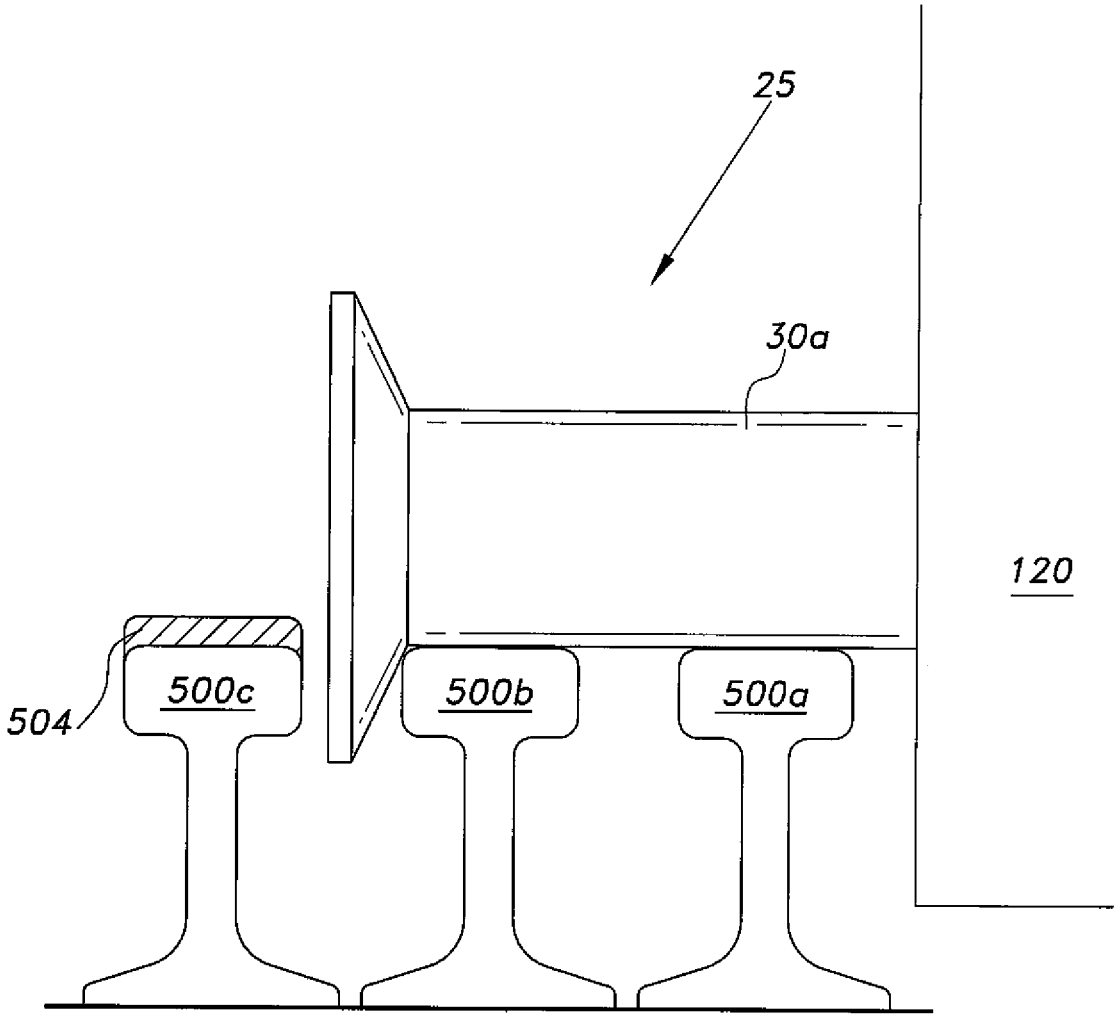
FIG. 2B is a diagrammatic end view of the rail sections where the personal transportation rail (PTR) pod wheel extends to the switch rail in a personal transportation rail system according to the present invention.
Figure 2C:
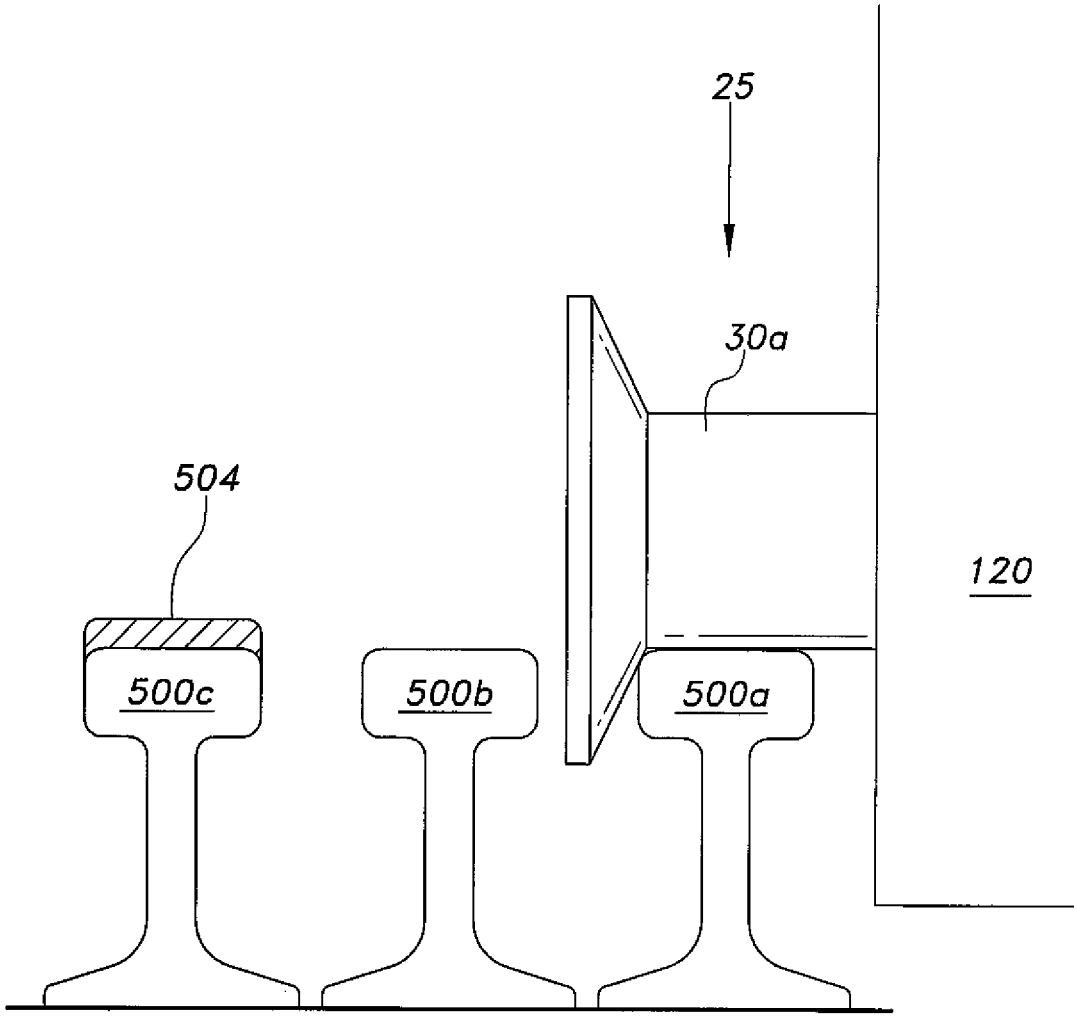
FIG. 2C is a diagrammatic end view of the rail sections where the PTR pod wheel is retracted to the main rail in a personal transportation rail system according to the present invention.
Figure 3:
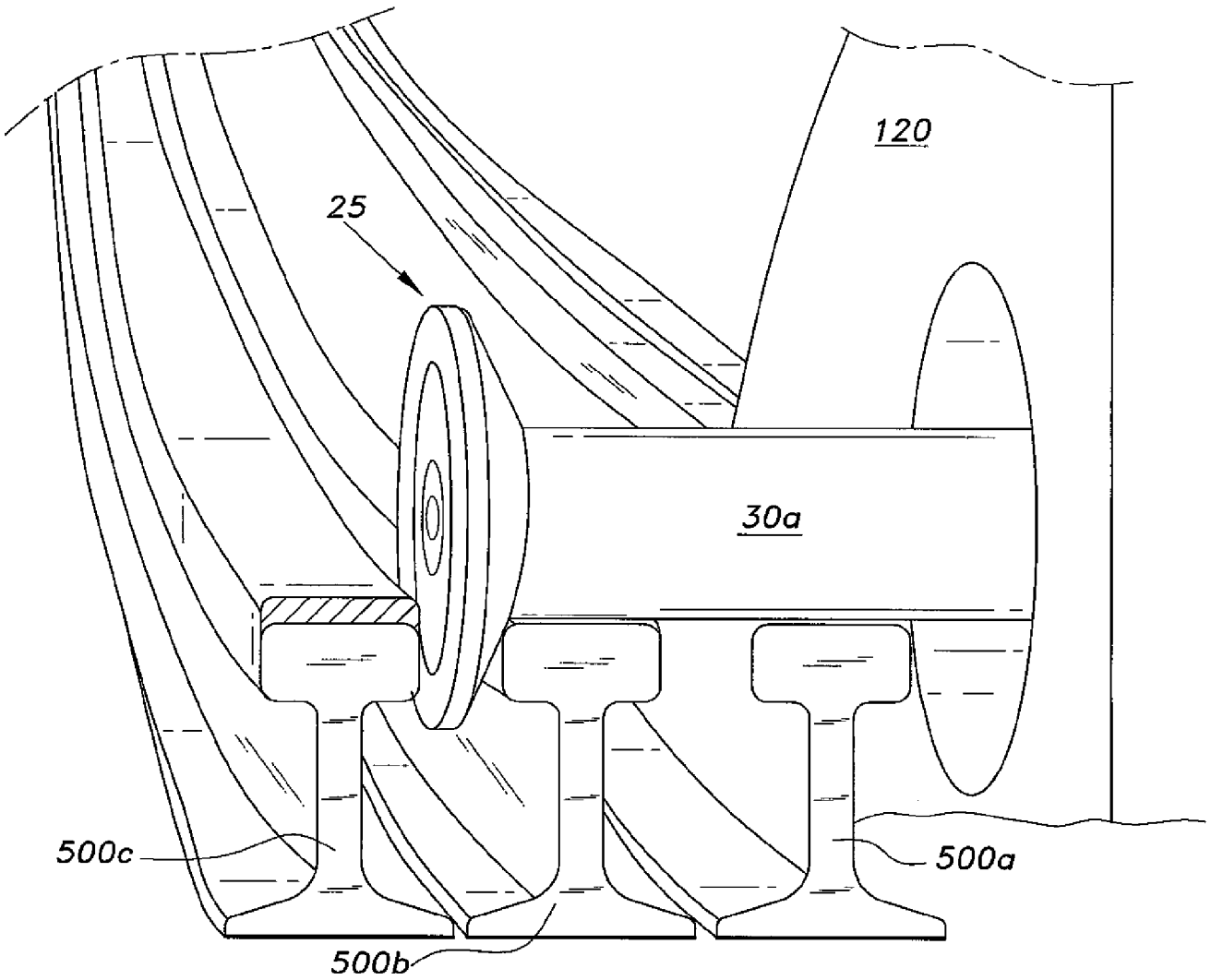
FIG. 3 is a perspective view showing the rail sections where the PTR pod wheel extends to the switch rail in a personal transportation rail system according to the present invention.
Figure 4:
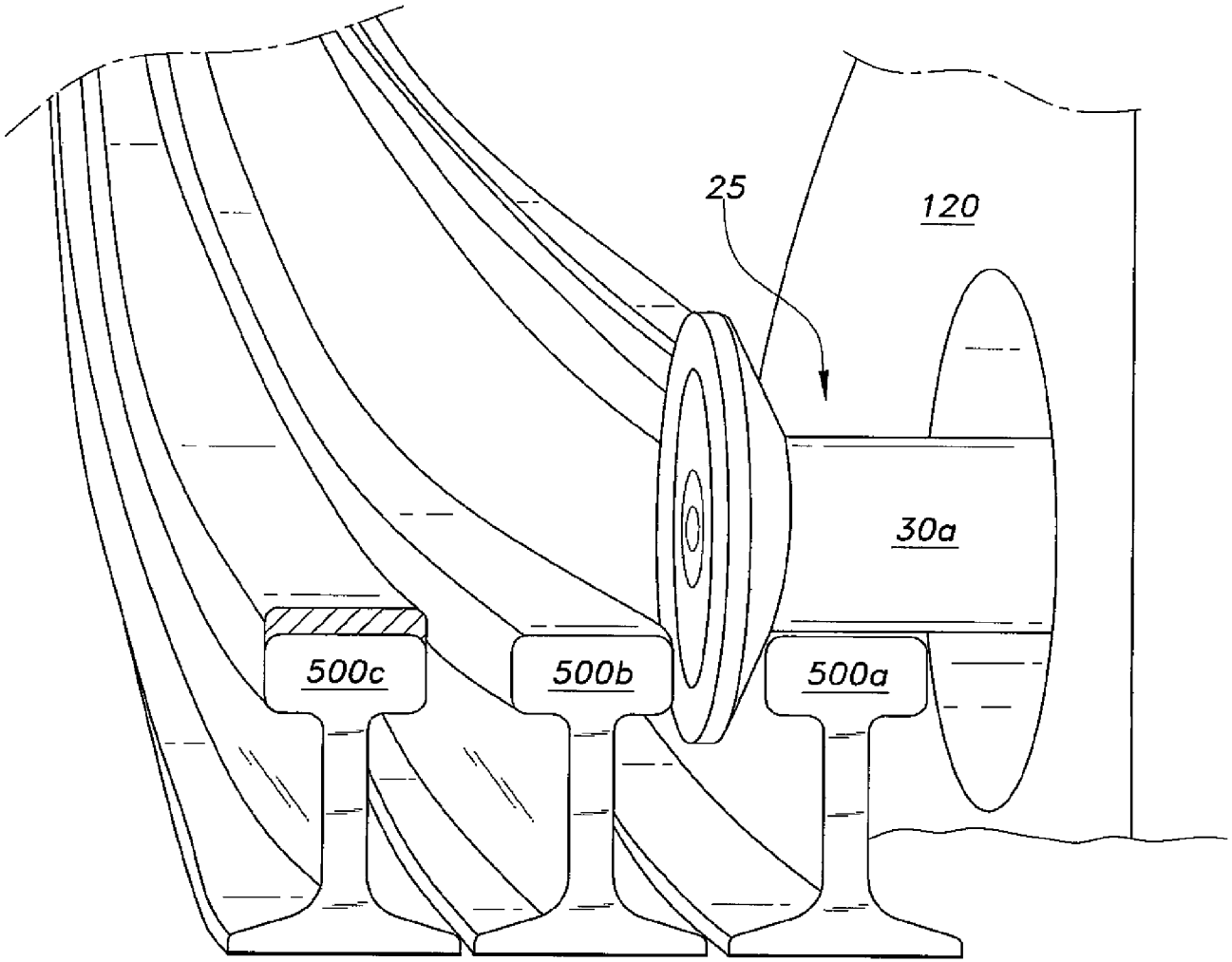
FIG. 4 is a diagrammatic partial perspective view, partially in section, showing the rail sections where the PTR pod wheel retracts to the main rail in a personal transportation rail system according to the present invention.
Figure 5:
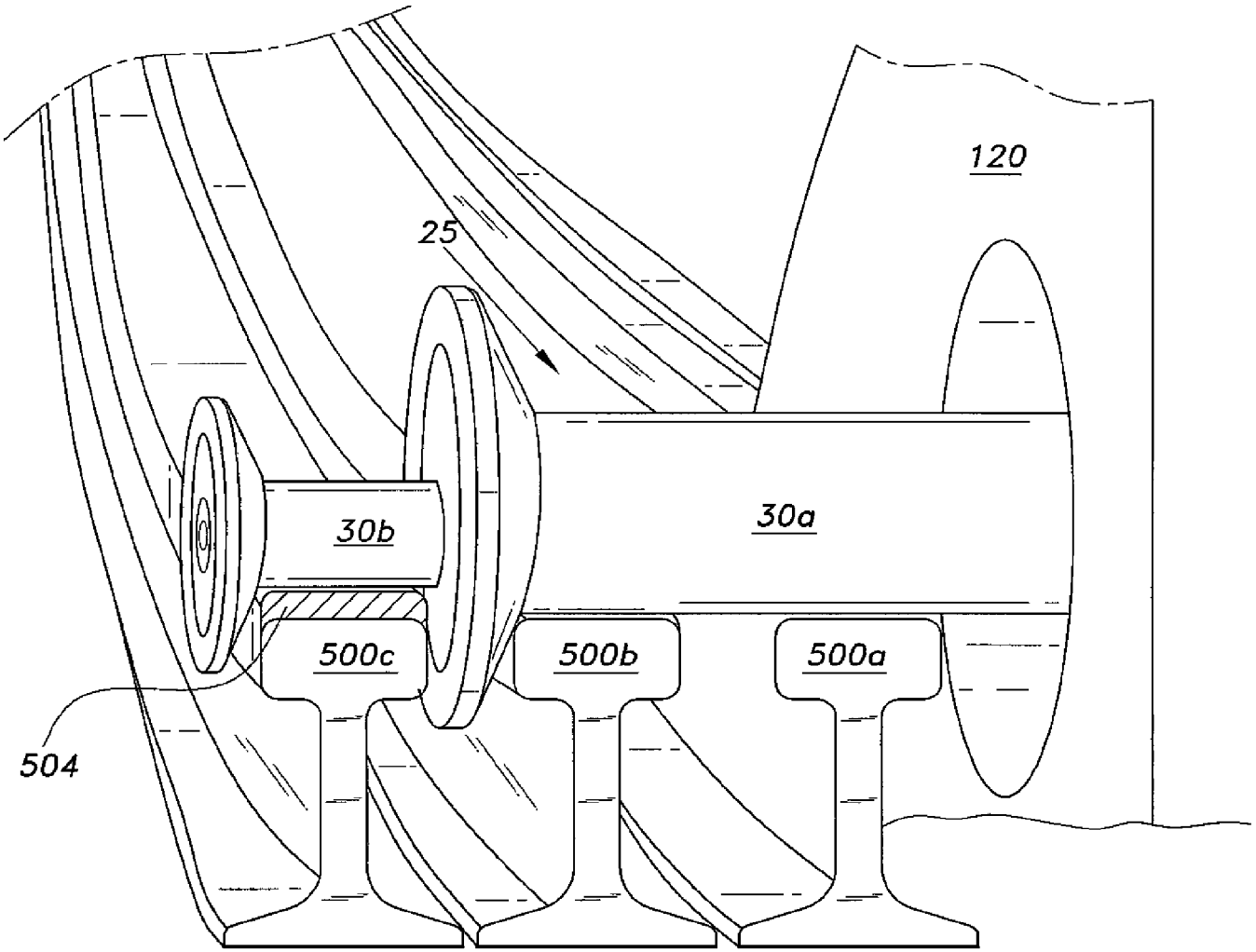
FIG. 5 is a diagrammatic partial perspective view, partially in section, showing the rail sections where the PTR pod wheel extends to the cog rail in a personal transportation rail system according to the present invention.

As shown in FIG. 2B, the wheel assembly 25 of the vehicle 120 can also be configured to cause the vehicle 120 to enter/exit the rail guideway station 770 by engaging the main rail 500*a* and the switch rail 500*b*, but not the cog rail 500*c*. As shown in FIG. 2C, the wheel assembly 25 of the vehicle 120 can further be configured to cause the vehicle 120 to travel using solely the narrow-gauge main rail 500*a* by engaging the main rail 500*a*, but not the switch rail 500*b* or cog rail 500*c*. FIGS. 3, 4, and 5 show perspective views of the aforementioned wheel/rail engagement combinations.

Figure 6A:
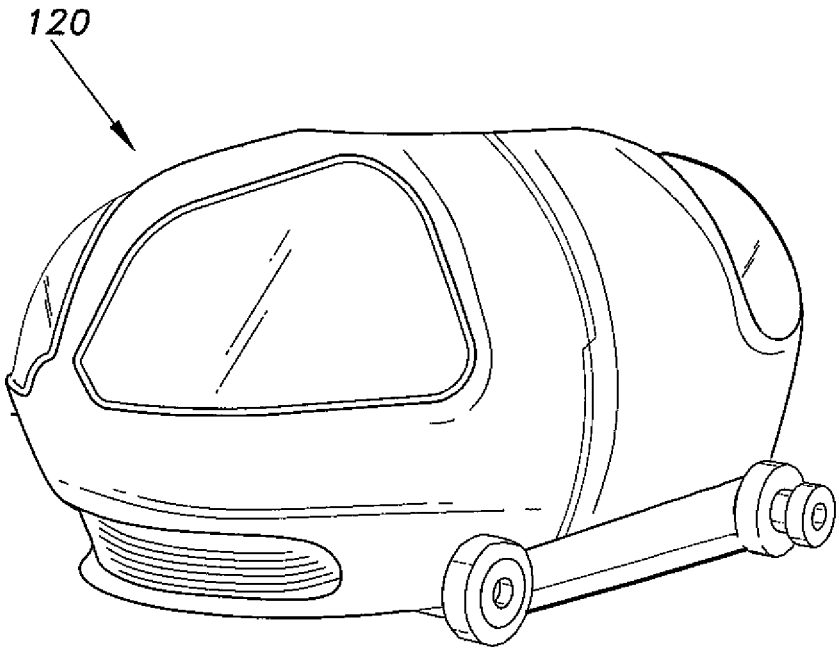
FIG. 6A is a perspective view of a PTR pod in a personal transportation rail system according to the present invention.
Figure 6B:
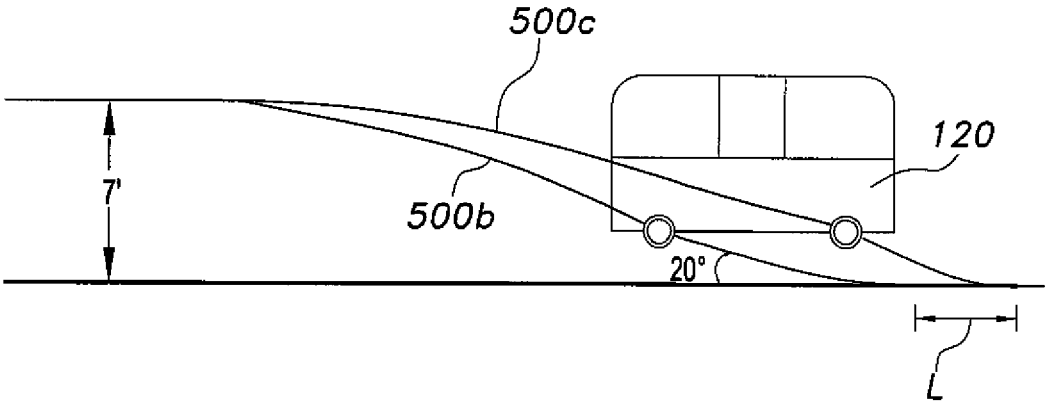
FIG. 6B is a diagrammatic side view showing the leveling rail concept of the personal transportation rail system according to the present invention.

As shown in FIG. 6A, the PTR vehicle 120 is pod-shaped, and has a predetermined, relatively long wheelbase. As shown in FIG. 6B, the predetermined, relatively long wheelbase of vehicle 120 is used to its advantage when two of the three rail pairs (for example, cog rail pair 500*c* and switch rail pair 500*b*) are used for a vertical component of vehicle travel during travel on an entrance or exit ramp of the rail system. The example shown has a 20° slope. However, use of the two rail pairs 500*c*, and 500*b* keeps the vehicle attitude pitch neutral, i.e., level.

Figure 7:
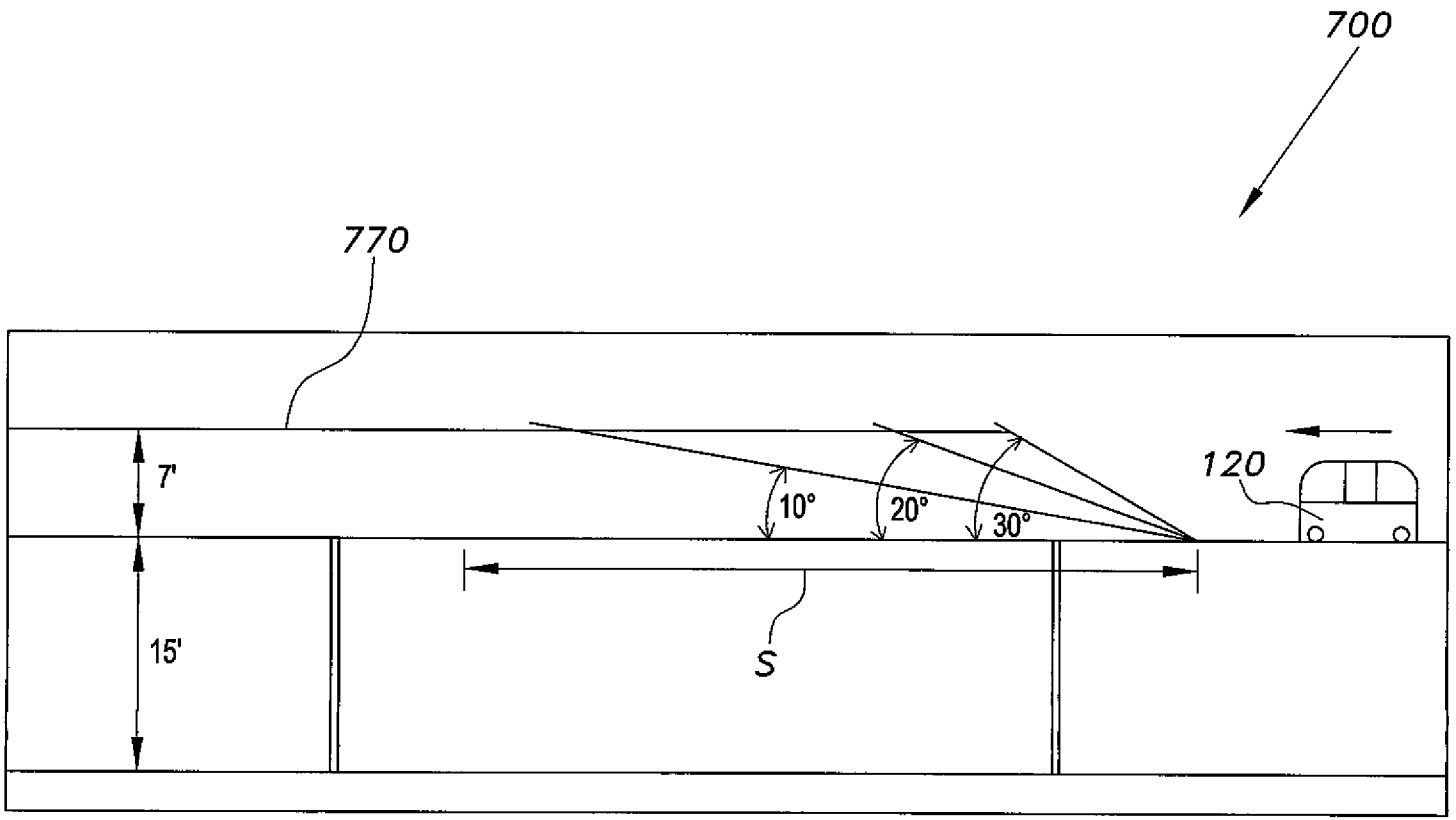
FIG. 7 is a first schematic diagram showing how ramps with higher angles of ascent require much less room, according to the present invention.

As shown in FIG. 7, a non-leveling configuration 700 can provide 10°, 20°, or 30° ramp slopes for a vehicle 120 having length of seven feet and a height of five feet where travel from a guideway station level twenty-two feet above street level to a main level fifteen feet above street level is required.

Figure 8:
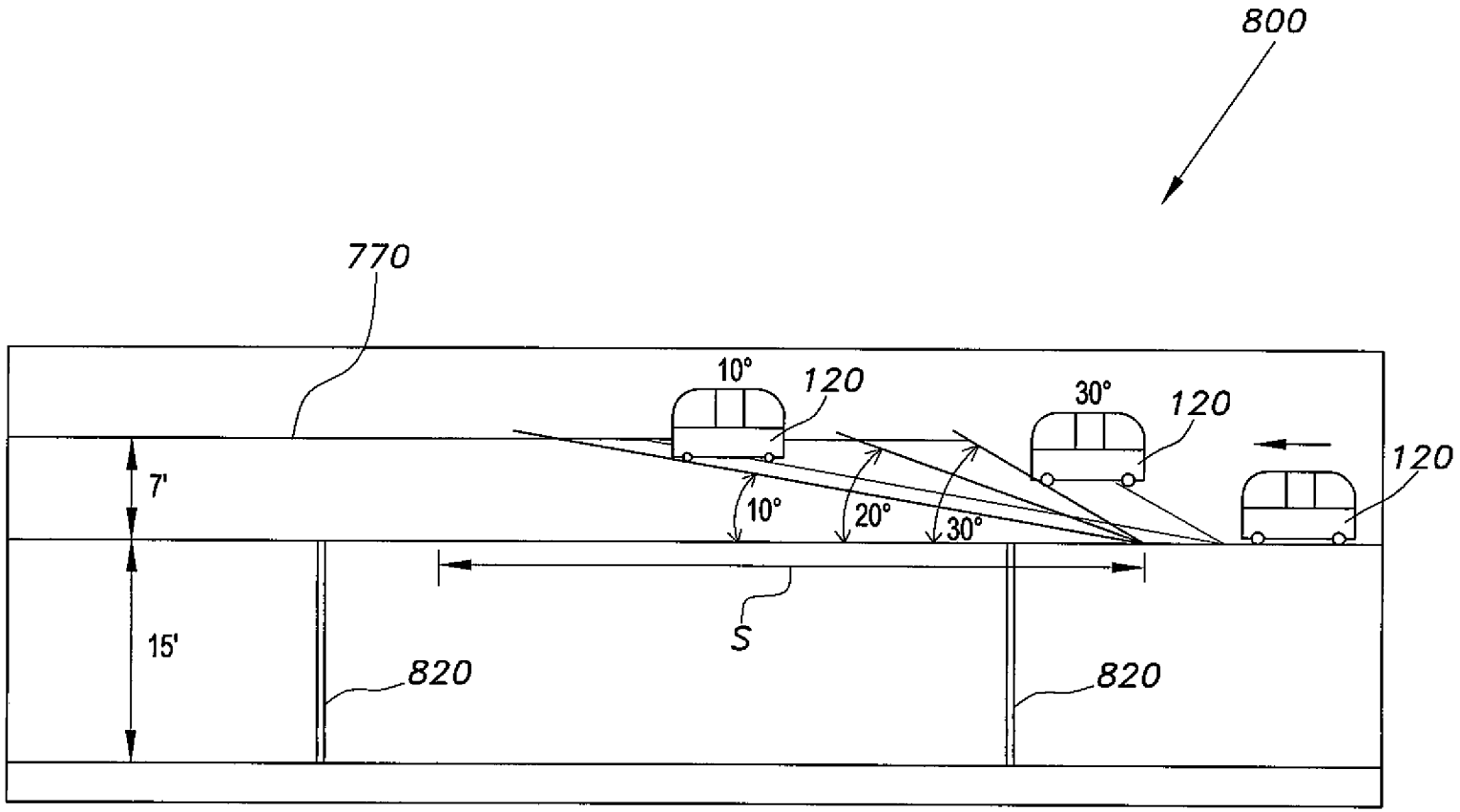
FIG. 8 is a second schematic diagram showing how ramps with higher angles of ascent require much less room, according to the present invention.

As shown in FIG. 8, a leveling configuration 800 also provides 10°, 20°, or 30° ramp slopes for the vehicle 120, except that in the leveling configuration, two pairs of rails (for example, cog and switch rails) are used, one pair engaging the front wheels of the vehicle 120 and the second pair engaging the rear wheels of the vehicle 120. As shown in FIG. 6B, there is a linear displacement L (rail pair 500*c* begins its ascent grade in advance of rail pair 500*b*) between the ascending grade starting points of the two rail pairs so that a rail vehicle engaging both rail pairs remains pitch neutral, i.e., level, as it ascends to the guideway station 770. In the descent from the station 770, the reverse is true (i.e., rail pair 500*c* begins its descent grade after the descent grade start point of rail pair 500*b*). If using a steeper entry/exit ramp of 30° and keeping the vehicle horizontal, i.e., pitch neutral, the loss of guideway station floor space is about sixty square feet at the ramp entrance and sixty square feet at the exit, i.e., one hundred twenty square feet, total. If using an entry/exit ramp of 10°, it will increase to about one hundred sixty plus one hundred sixty, or three hundred twenty square feet. Since all guideway stations 770 are elevated, this added surface area is important. Support columns 820 extend above street level and are a nominal fifteen feet in length. Protection from electrocution of people in the stations may include a final length of switch and cog rails that is non-powered, using external inertia controls (friction brakes and drive wheels) within the station for final deceleration, positioning, and initial acceleration out of the station 770.

Figure 9:
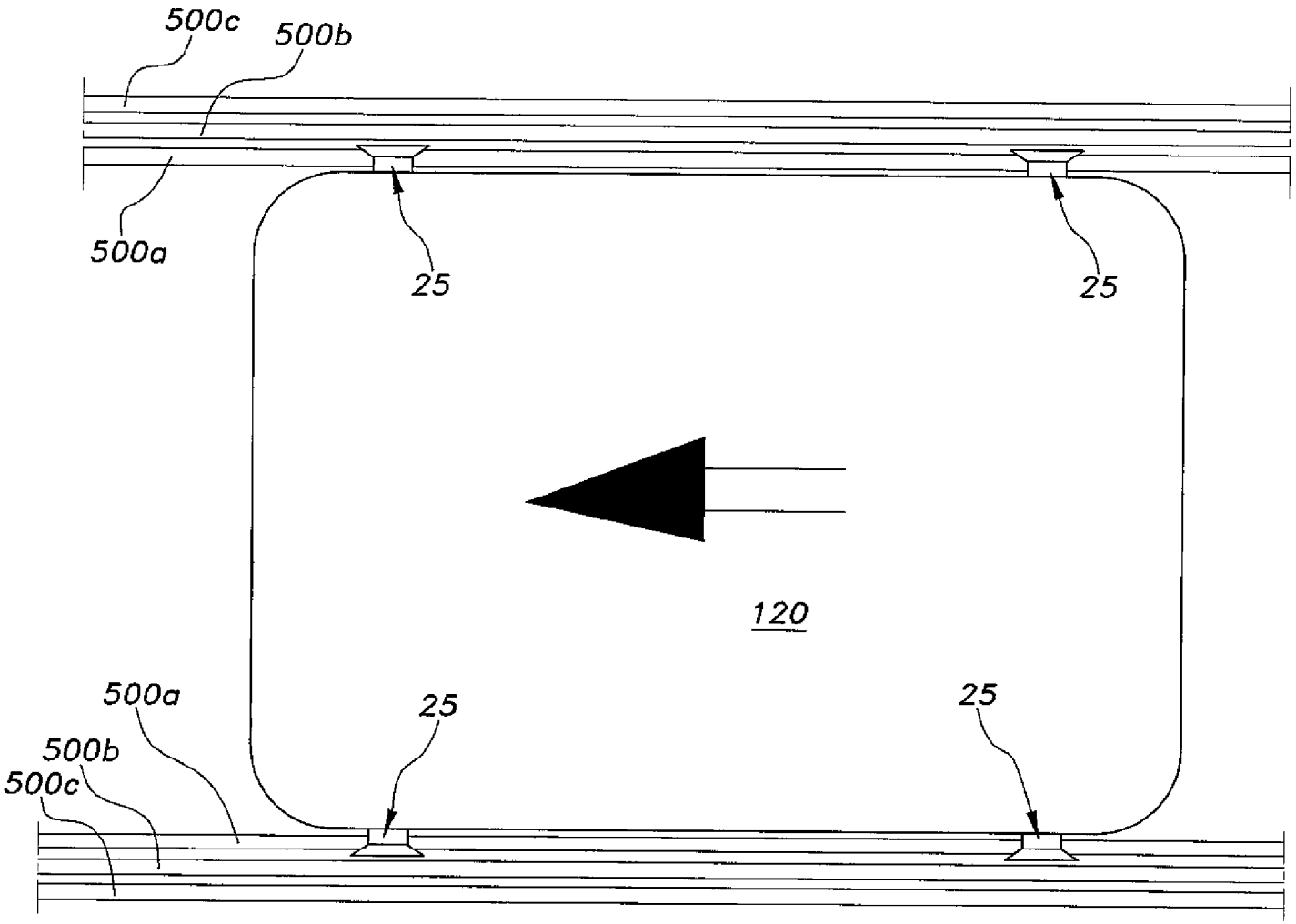
FIG. 9 is a top plan view showing the PTR pod wheels configured in "guideway station bypass mode" in a personal transportation rail system according to the present invention.
Figure 10:
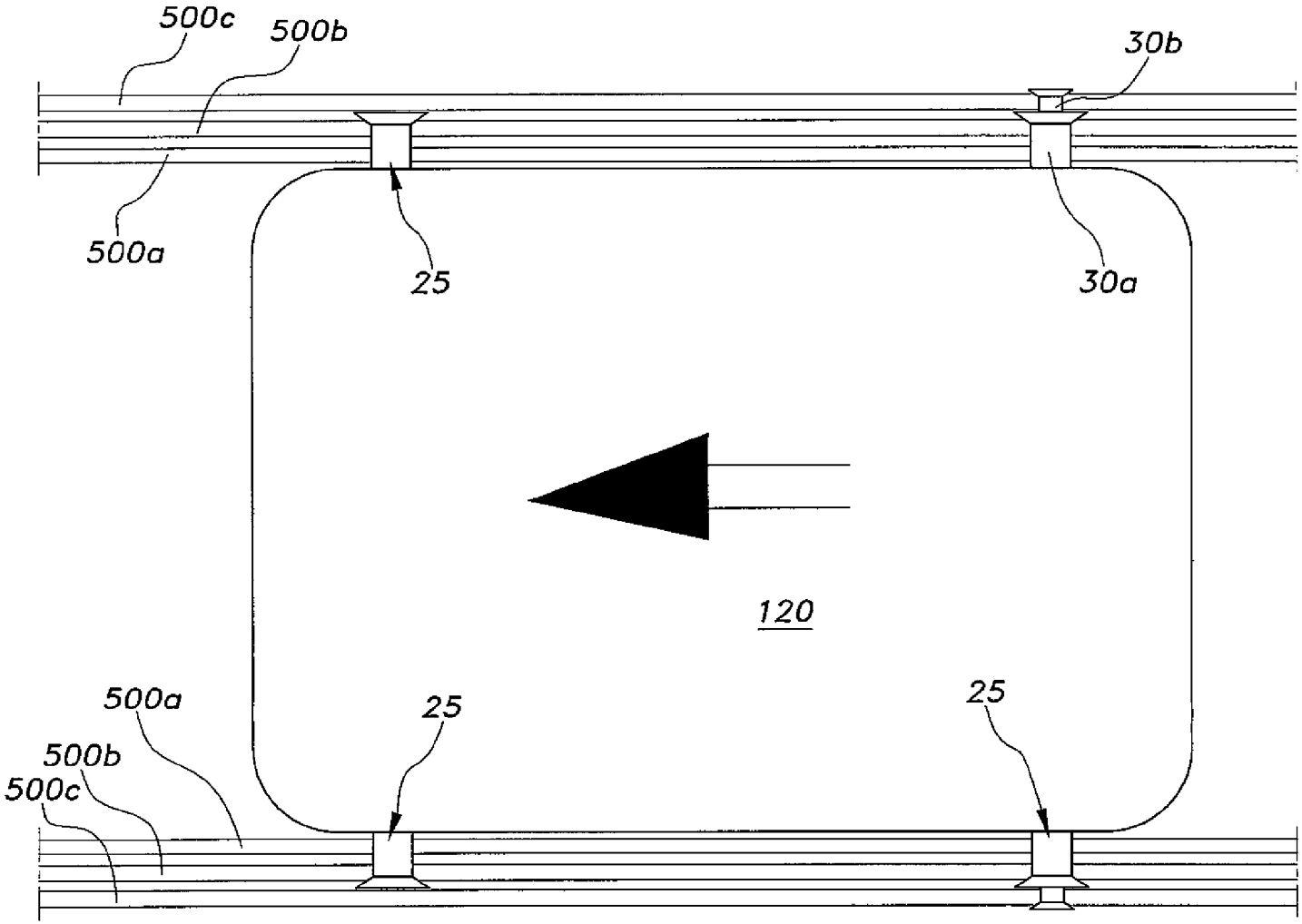
FIG. 10 is a top plan view showing the PTR pod wheels configured in "exit to guideway station" mode with the third cog rail engaged, according to the present invention.
Figure 16B:
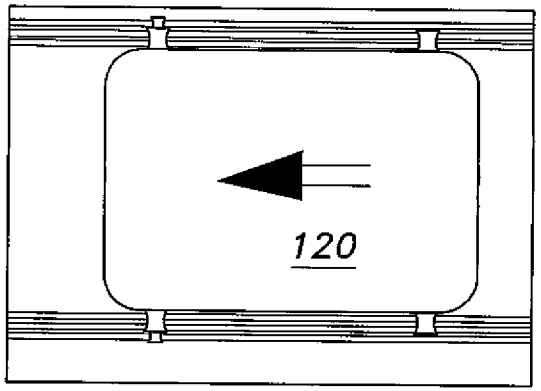
FIG. 16B is a top plan view showing the PTR pod and rail configuration of FIG. 16A in a personal transportation rail system according to the present invention.
Figure 16A:
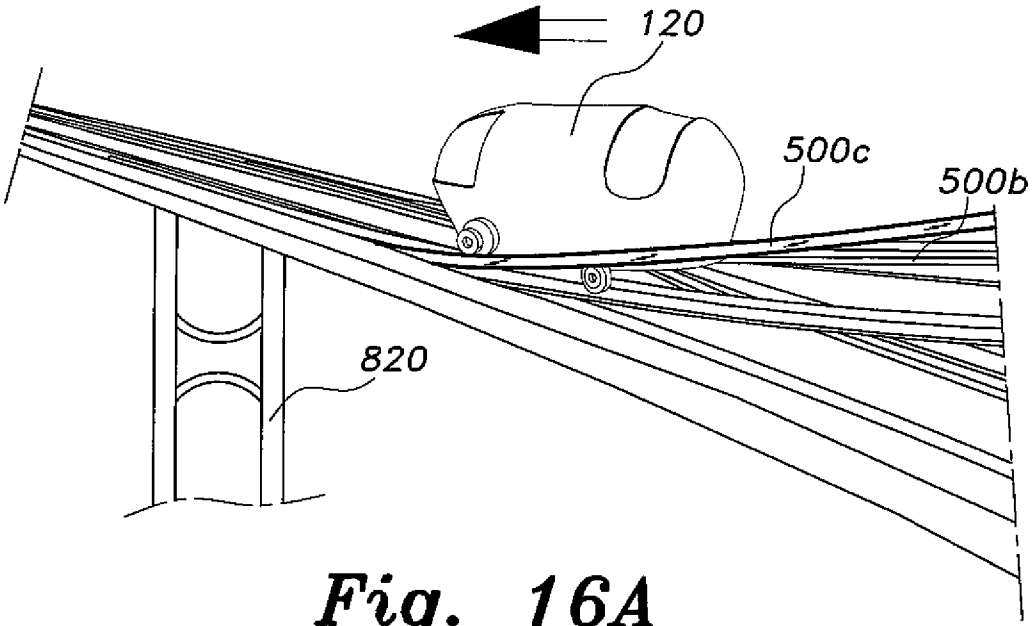
FIG. 16A is a partial perspective view showing the PTR pod and rail configuration in a "leveling, entering-system-from-guideway station" mode in a personal transportation rail system according to the present invention.

FIG. 9 shows the guideway station bypass configuration in which the wheels 25 are engaged solely with the narrow-gauge rails 500*a*. FIG. 10 shows the exit-to-guideway station configuration in which the wheels 25 are extended in the front to engage the switch rails 500*b* and the wheels 25 are extended in the back via wheel portion 30*b* to engage the cog rails 500*c*. This rail/wheel configuration will cause the vehicle 120 to ascend above the main line and into the guideway station 770, the vehicle remaining pitch neutral during the ascent. As shown in FIGS. 16A and 16B, re-entry into the main line from the guideway station 770 is achieved by the wheels 25 being extended in the front via wheel portion 30*b* to engage the cog rails 500*c* and the wheels 25 being extended in the back to engage the switch rails 500*b*. This rail/wheel configuration will cause the vehicle 120 to descend below the guideway station 770 and onto the main line, the vehicle remaining pitch neutral during the descent.

Figure 11A:
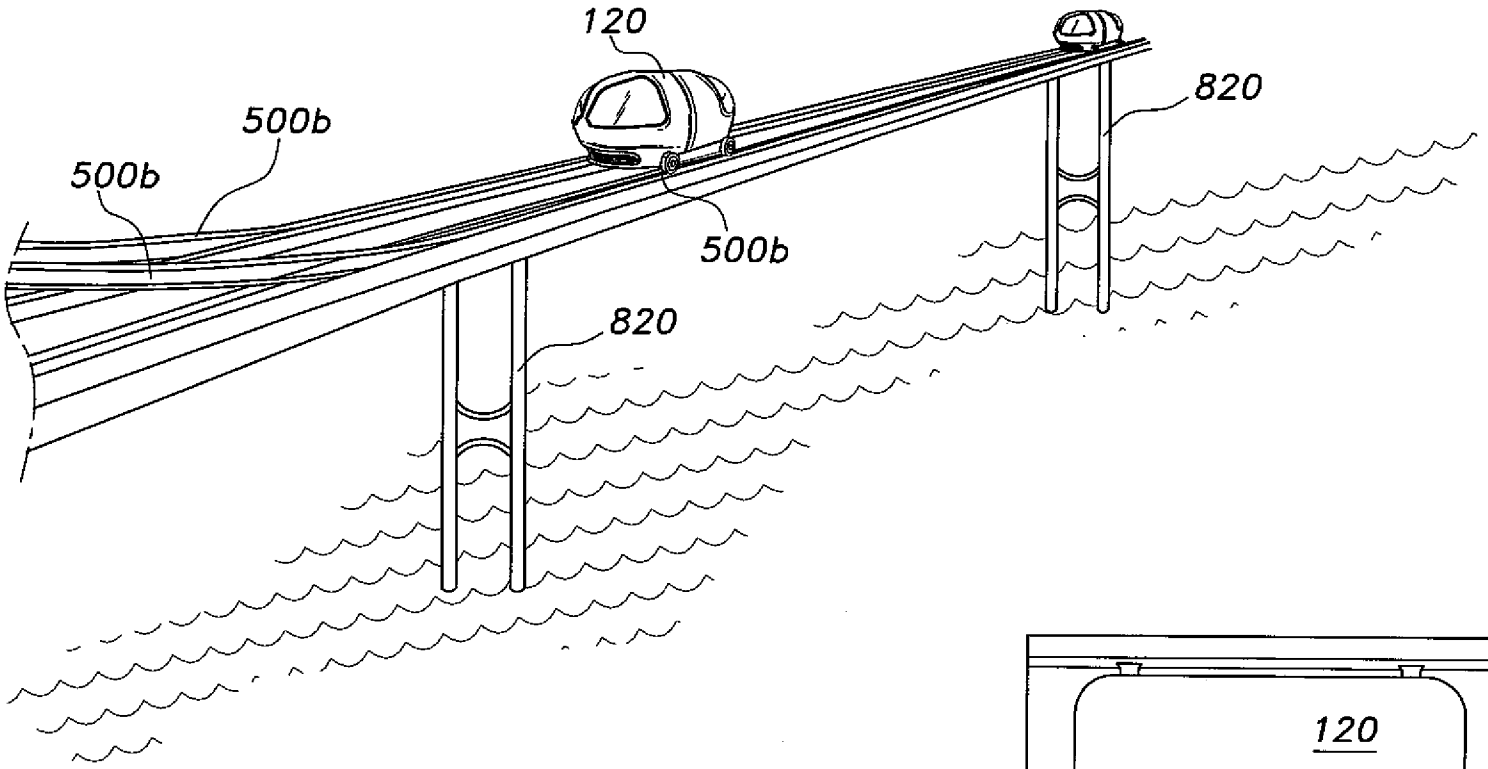
FIG. 11A is a partial perspective view showing the PTR pod in non-leveling in-transit contact with the rails in a personal transportation rail system according to the present invention.
Figure 11B:
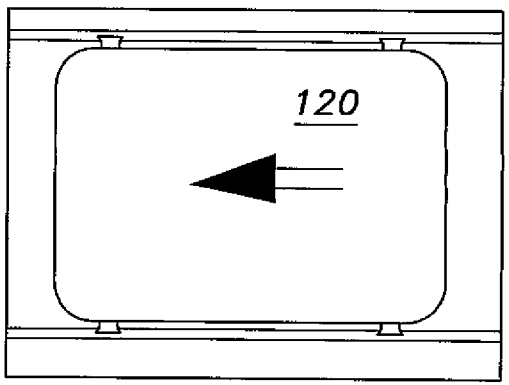
FIG. 11B is a top plan view showing the PTR pod and rail configuration of FIG. 11A in a personal transportation rail system according to the present invention.
Figure 12A:
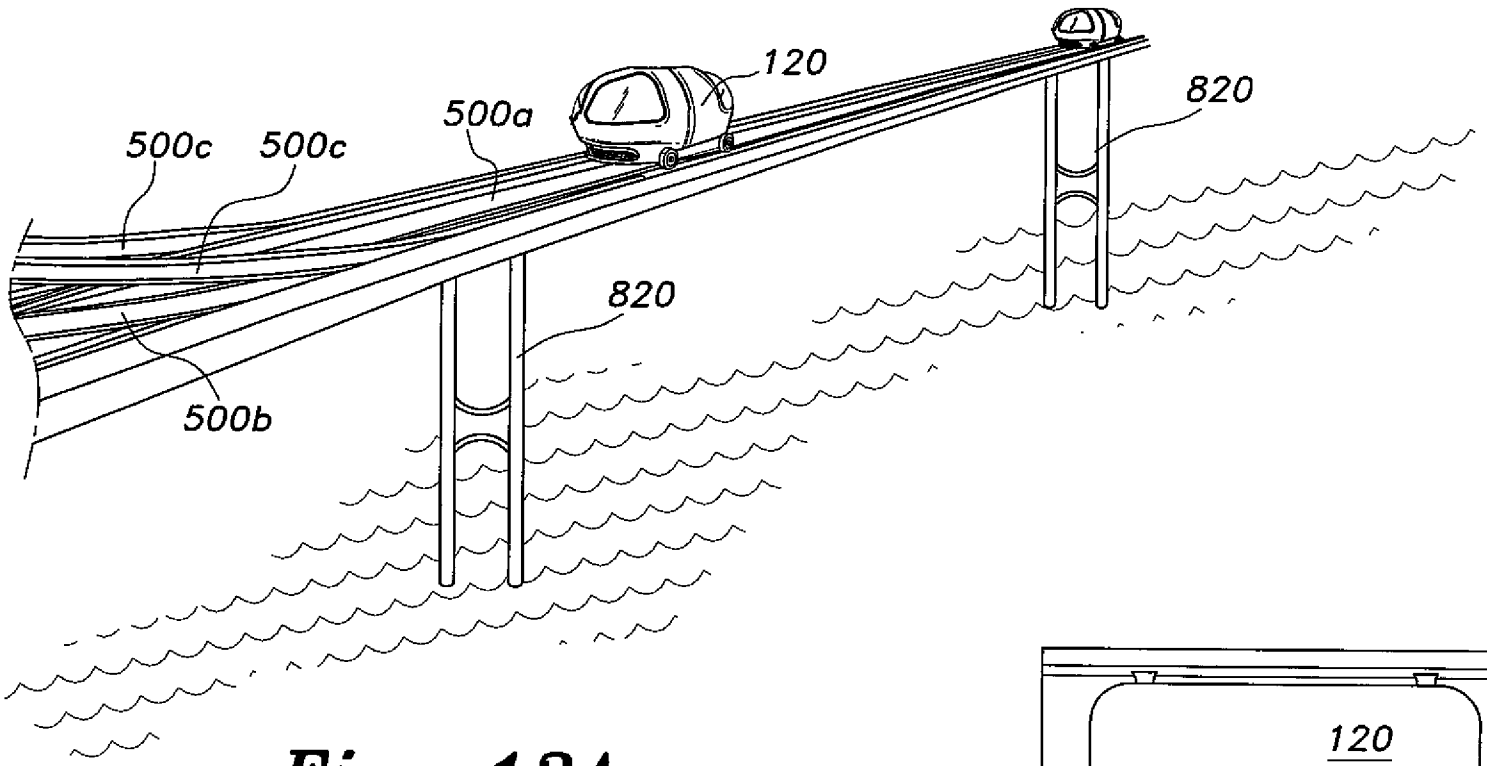
FIG. 12A is a partial perspective view showing the multi-rail leveling PTR pod and rail in-transit configuration in a personal transportation rail system according to the present invention.
Figure 12B:
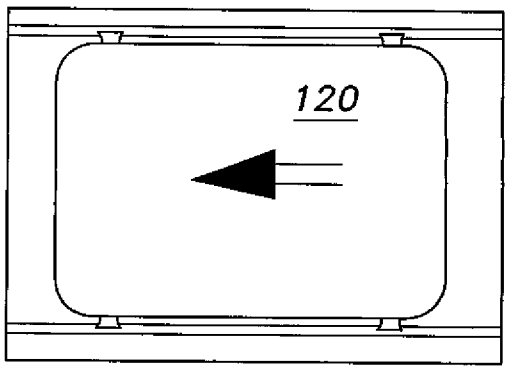
FIG. 12B is a top plan view showing the PTR pod and rail configuration of FIG. 12A in a personal transportation rail system according to the present invention.
Figure 13B:
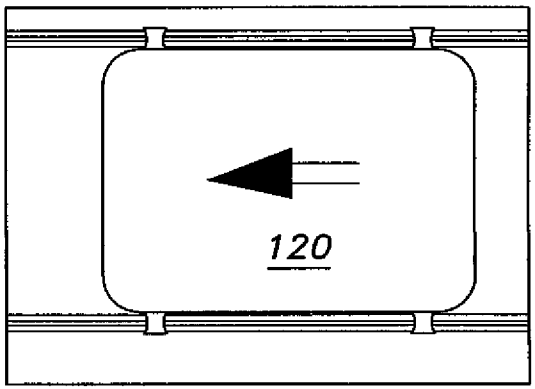
FIG. 13B is a top plan view showing the PTR pod and rail configuration of FIG. 13A in a personal transportation rail system according to the present invention.
Figure 13A:
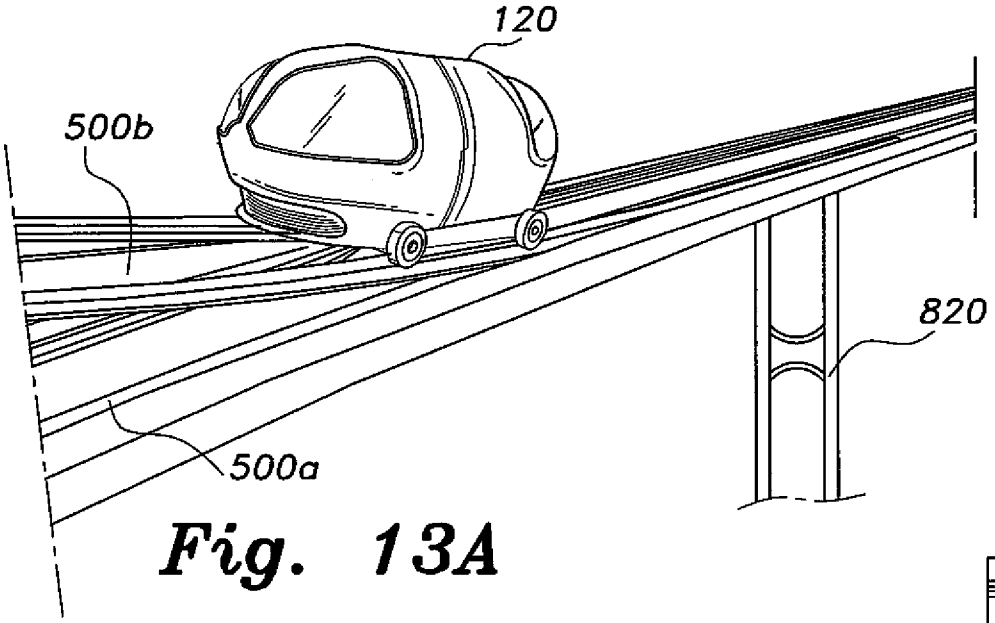
FIG. 13A is a partial perspective view showing the PTR pod and rail configuration in an "exit-to-guideway station" mode in a personal transportation rail system according to the present invention.
Figure 14B:
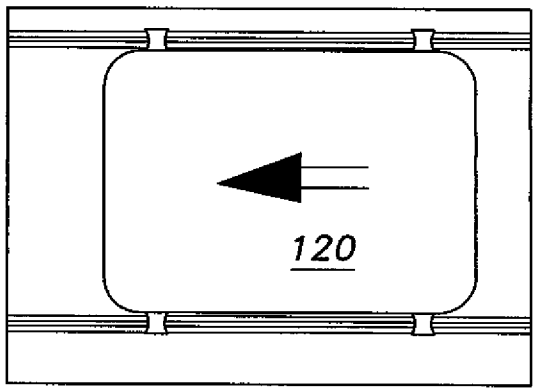
FIG. 14B is a top plan view showing the PTR pod and rail configuration of FIG. 14A in a personal transportation rail system according to the present invention.
Figure 14A:
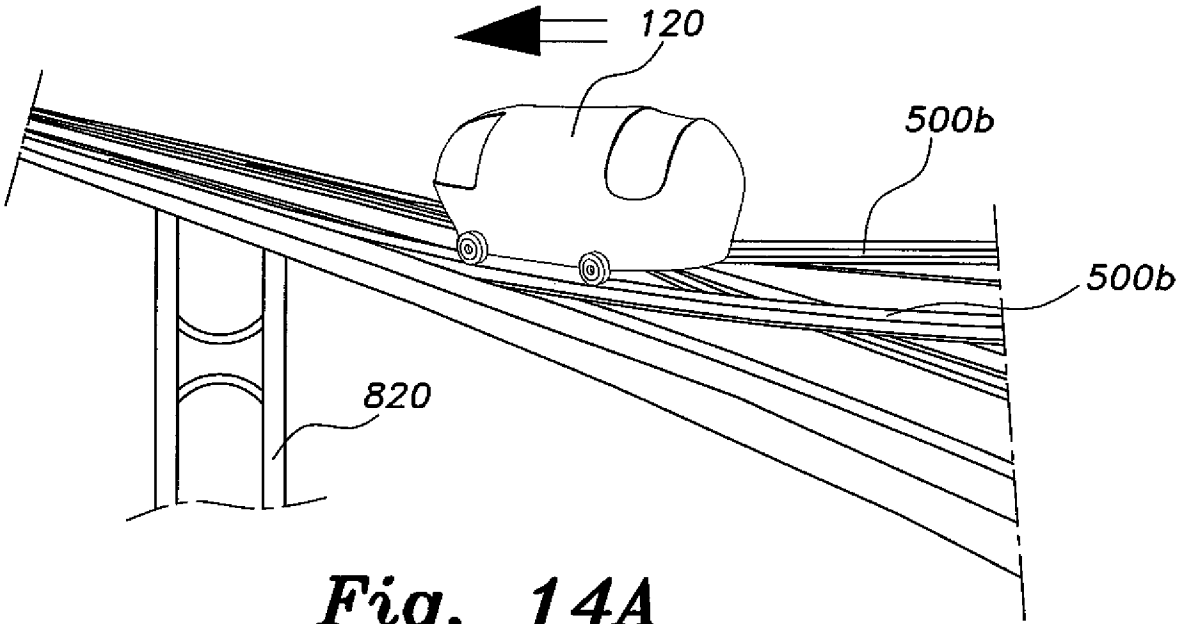
FIG. 14A is a partial perspective view showing the PTR pod and rail configuration in an "entering-system-from-guideway station" mode in a personal transportation rail system according to the present invention.

FIG. 11A shows the vehicle 120 in transit between guideway stations. FIG. 11B shows the wheel/rail engagement configuration of the vehicle 120 as it is in transit between guideway stations having a non-leveling rail arrangement. FIG. 12A shows the vehicle 120 in transit between guideway stations. FIG. 12B shows the wheel/rail engagement configuration of vehicle 120 as it is in transit between guideway stations having a leveling rail arrangement. FIG. 13A shows the vehicle 120 exiting to a guideway station 770 having a non-leveling rail arrangement, FIG. 13B shows the wheel/rail engagement configuration of vehicle 120 as it is exiting to the guideway station having the non-leveling rail arrangement. FIG. 14A shows the vehicle 120 entering the system from a guideway station 770 having a non-leveling rail arrangement. FIG. 14B shows the wheel/rail engagement configuration of vehicle 120 as it is entering the system from the guideway station having the non-leveling rail arrangement.

Figure 15B:
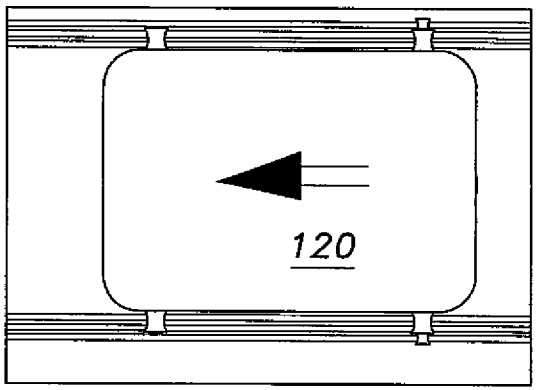
FIG. 15B is a top plan view showing the PTR pod and rail configuration of FIG. 15A in a personal transportation rail system according to the present invention.
Figure 15A:
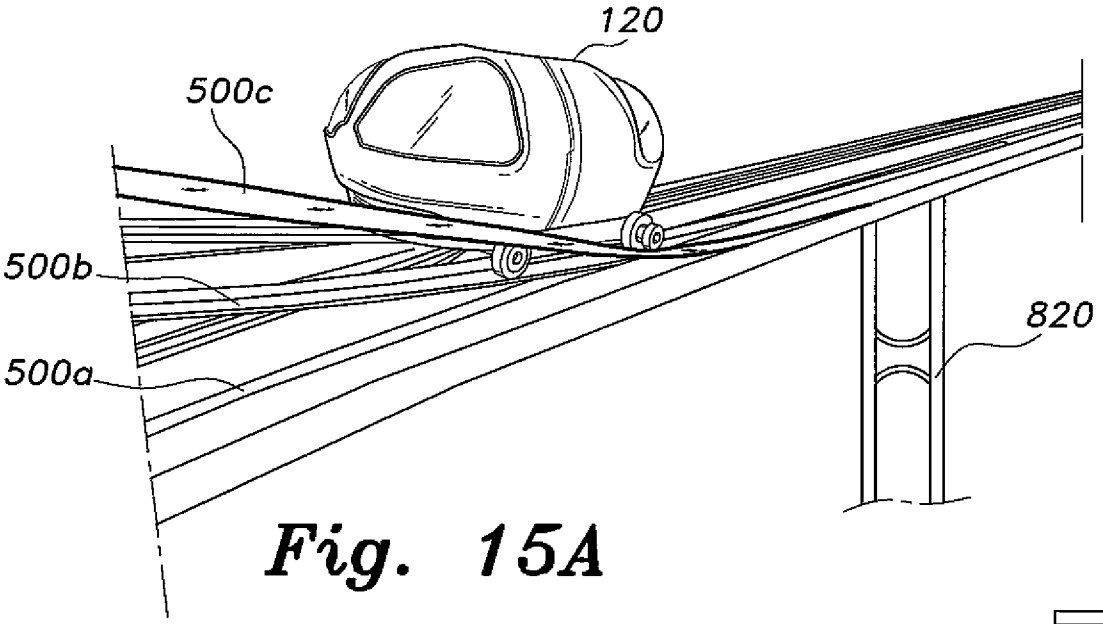
FIG. 15A is a partial perspective view showing the PTR pod and rail configuration in a "leveling, exiting-to-guideway station" mode in a personal transportation rail system according to the present invention.
Figure 17:
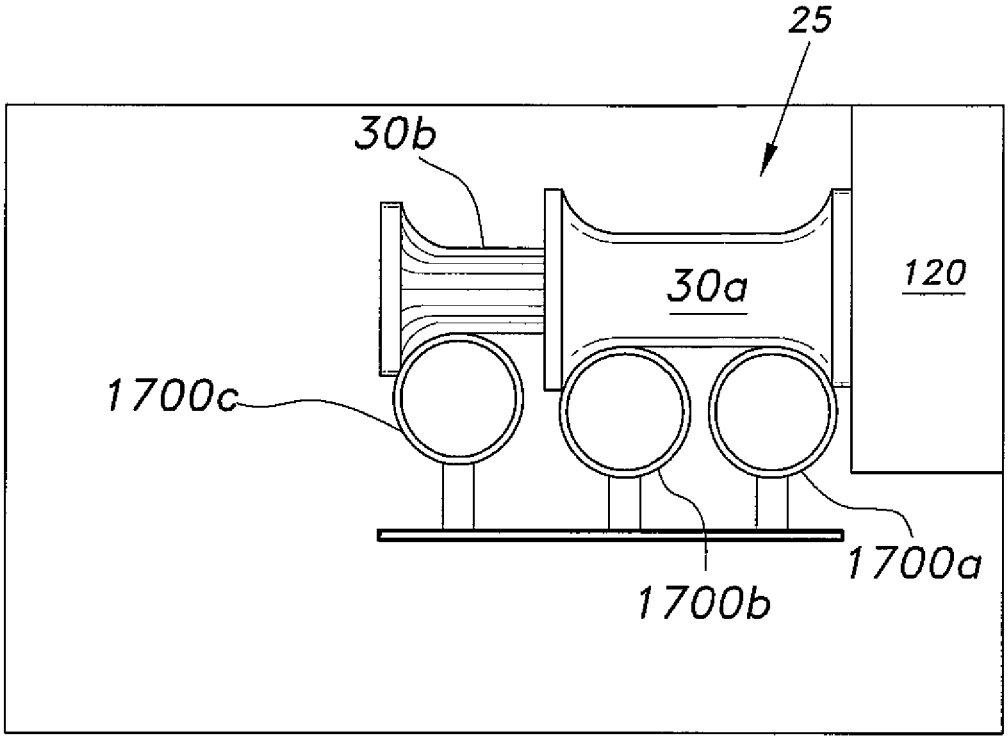
FIG. 17 is a partial diagrammatic end view showing the PTR pod wheels supported by tubular version of the rails in a personal transportation rail system according to the present invention.

FIGS. 15A and 15B reiterate the leveling configuration required for the vehicle 120 to exit to the guideway station 770 while remaining pitch neutral during the ascent. Additionally, FIG. 17 shows the rails in tubular format showing cylindrically tubular cog rail 1700*c*, switch rail 1700*b* and main rail 1700*a*. The cylindrically tubular shape of these rail members is complemented by a wheel design of main wheel 30*a* and cog wheel 30*b* that is flanged to match the outer cylindrical contours of the rail members 1700*a*, 1700*b*, and 1700*c*.

This elevated system is designed for performing above legacy traffic systems using rail switching systems in which rail vehicles under computer control perform the required track switching, as disclosed in U.S. Pat. No. 7,788,000, issued to Davis on Aug. 21, 2010, which is hereby incorporated by reference in its entirety. A rail system monitor computer determines speed, acceleration, location, and separation distance of vehicles 120 utilizing the rail system 100. A rail system control computer in operable communication with the rail system monitor computer adjusts speed of the vehicles 120 and separation distance of the vehicles 120 on the rail system responsive to the information from the rail system control computer. The rail system control computer accomplishes rail switching by selective actuation of the main 30*a* and cog 30*b* components of rail engagement wheels 25. The aforementioned rail switching systems take advantage of the only space left in congested urban environments, i.e., the space above the streets and sidewalks/greenery. In order to relieve surface congestion we need to utilize some of this space without polluting the streets or air. The personal transportation rail system 100 contemplates taking advantage of open space without polluting, and minimizes the physical appearance while improving all traffic flow.

Most guideway stations 770 will be elevated approximately six feet above the main track, which requires fifteen feet clearance above the street. The present system contemplates that many department stores, business buildings, and major industrial buildings will be willing to have a personal transportation rail (PTR) guideway station 770 connected to the side of their building at the second floor. All PTR guideway stations 770 will require an elevator from ground level to the guideway station level. The frequency of use and size of each guideway station 770 will be determined by anticipated use, available temporary PTR vehicle storage at the guideway station 770, etc.

Preferably all PTR traffic should be one-way on each side of a major through-way, maximizing esthetics, while reducing noise, and switching problems. However, two-way may be more economical. The present system minimizes the amount of horizontal space required for either one-way or two way-tracks, and for switching and guideway stations 770.

The guideways that the PTR vehicles travel on will deliver electric power to the vehicles and collect the users' costs and send the data to the PTR managing agency, which will send data to all of the users' local power companies for collection. This concept has PTR vehicle storage/parking areas in many multilevel high rise facilities for compact overnight storage, maintenance and redistribution of vehicles. During working hours, they are distributed to areas with anticipated heavy needs. Other than maintenance crews, the anticipated needs will be established by special computer analysts. Each day/night, the vehicles will be pre-distributed as directed by the crews, ready for that day's traffic. Once established, the present PTR intermediate public transit system will become very popular, requiring one less family car/truck per household.

Roller-coaster technology is used in constructing low visibility guideways having the dual mode, i.e., the BiModal guideway disclosed in the aforementioned U.S. Pat. No. 7,788,000. The several types of vertical switches disclosed therein are incorporated herein. Tube type rails and supporting structures for PTR Tubular versions may be used for the rail portion of the bimodal guideway.

The two aforementioned switching systems (single-rail non-leveling, and multi-rail leveling) will be tested to determine which is most effective for the present PTR system. Both systems use vertical switches that require using wide gauge tracks and wheels. Switching is achieved by a separate set of tracks laid outside of, parallel to, and at the same level as the main line.

The basic single rail switch enables PTR vehicles 120 to separate from the main line by extending their driving wheels further out from the sides of the vehicle, engaging a second set of wider gauge parallel rails, and riding them up a ramp to the next level (the guideway station level.) It requires all four axles and wheels being extended further out of the sides of the PTR vehicle at a precise predetermined location on the main line, just prior to arriving at the switching position. These extended extra-wide wheels will ride on both the additional track and the main line at the same time, temporarily, at the same level and parallel to the main line. These four wheels are extra-wide, having cone shaped treads and a slightly smaller diameter at the center of each tread, similar to railroad wheel treads. The exit ramps and switching rails have a wider gauge than the width of the PTR vehicles, so that successive vehicles not exiting to a particular guideway station 770 will proceed between the switching and exit rails without having to reduce speed.

An exiting vehicle does not have to slow down from its standard speed to enter a ramp and drive up to the PTR guideway station 770. In order to conserve horizontal space and speed up this processing of passengers, the present system contemplates a design with most guideway stations 770 elevated about six feet above the main line. This requires more energy going up, but that energy will be recouped coming back down, and it means more space for the public and temporary storage of six or seven empty and ready vehicles. The limited footprint also allows for more floor space inside the associated department store, business building, etc. An automated control system will keep track of the location of all vehicles at all times. This system will use substantially the same control system as disclosed in U.S. Pat. No. 7,788,000, where at every few feet of the track, there is a bar graph visible to the present PTR vehicle's receiver that establishes its precise location, movement, acceleration, speed, and other operational information as may be determined important to the operation of the system. All of this information is automatically transferred to the local PTR center controlling a district and all of its PTR vehicles. The PTR center redistributes the vehicles where needed when indicated by users/conditions and projected demands.

The second system (multi rail leveling switch) uses a third set of auxiliary rails and an additional cog, or high friction wheel at the end of the axles. This unique switching system allows vertical switching, while maintaining the horizontal position, (i.e., vehicle pitch) of the PTR pod while exiting or entering the system. During exit or re-entry into the system, the PTR pod's cog wheels extend out to catch the cog rail at the end of the pod that is furthest from the guideway station 770. Pods exiting the system will engage the cog rail with the rear cog wheels, and pods re-entering the system will engage the cog rail with the front cog wheels. This switching reduces the horizontal platform area needed by permitting a steeper slope for the exiting/entering ramps. It also requires more power and a cog wheel/guideway or high traction wheel/ramp system for the third rail. If used throughout a PTR system, it can contribute to reducing turnaround time and reduced costs (less elevated horizontal space). Adding a third, switching rail reduces the exit and entry ramp length, thereby increasing the floor area of elevated PTR guideway stations 770.

The PTR system can also allow for specially modified dual-mode, i.e., bimodal, Pods to operate on the system. These dual-mode Pods would enter at special street-level entry/exit stations. Moreover, by using common infrastructure, this PTR system could be combined with the bimodal guideway system for inter-urban transportation using the bimodal automotive vehicles such as disclosed in the Davis patent, U.S. Pat. No. 7,788,000.

Figure 18:
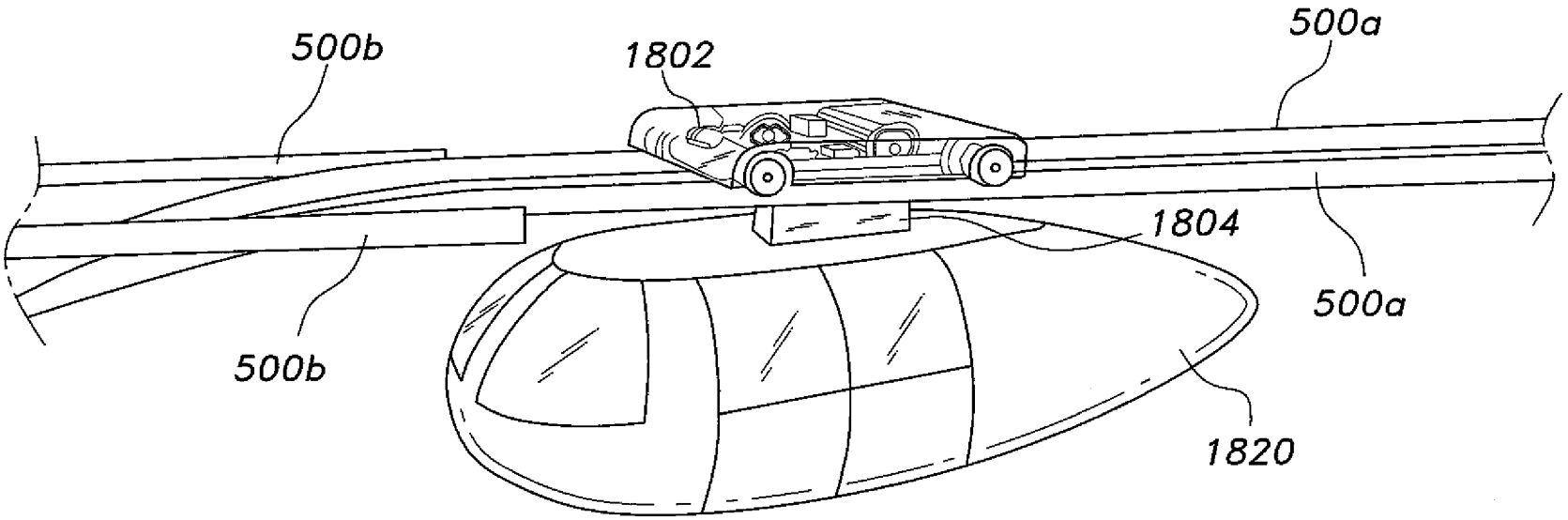
FIG. 18 is a perspective view showing a suspended PTR pod according to the present invention.

Additionally, the pods can be suspended vertically from an overhead track as an alternative design to riding on top of the rails (see FIG. 18), because some locations may prefer a suspension approach. As shown in FIG. 18, the vehicle is comprised of a bogey mechanism 1802 housing the rail engagement wheels. A cabin portion 1820 of the vehicle is suspended from the bogey mechanism 1802 via pod suspension member 1804. The switching system and other aspects are the same as the system utilized with the non-suspended pod 120.

It is to be understood that the present invention is not limited to the embodiments described above, but encompasses any and all embodiments within the scope of the following claims.

I claim:

1. A personal transportation rail system, comprising:

a system guideway station;

a first-gauge pair of rails and a second-gauge pair of rails, the rail pairs forming portions of a guideway facilitating entry to, exit from, and bypassing of the system guideway station, the rail pairs having an elevated throughway portion having the first and second rail pairs in parallel with each other at the same grade in advance of the system guideway station, the second-gauge rail pair having an ascending grade guideway station entry portion, the ascending grade guideway station entry portion ascending to and leveling off at the system guideway station;

support columns providing grading of at least one of the rail pairs above ground level;

a descending grade guideway station exit portion of the second-gauge rail pair descending from the system guideway station to a grade level of, and leveling off parallel to, the first-gauge rail pair beyond the system guideway station; and a third-gauge rail pair having an ascending grade guideway station entry portion ascending to and leveling off at the system guideway station, the entry portion having an ascent slope start linearly displaced in advance of an ascent slope start of the second-gauge rail pair;

whereby a rail vehicle engaging both the second-gauge ascending and the third-gauge ascending guideway station entry rail pair portions remains pitch neutral as the rail vehicle ascends to the guideway station.

2. The personal transportation rail system according to claim 1, wherein the third-gauge rail pair has a descending grade guideway station exit portion defining a descent slope start, the second-gauge rail pair having a descent slope start linearly displaced in advance of the descent slope start of the third-gauge rail pair, the third-gauge rail pair descending from the system guideway station to a grade level of, and leveling off parallel to, the first and second gauge rail pairs beyond the system guideway station;

whereby a rail vehicle engaging both the second-gauge descending and the third-gauge descending guideway station exit rail pair portions remains pitch neutral as it descends to the personal transportation rail system beyond the system guideway station.

3. The personal transportation rail system according to claim 2, further comprising:

a rail system monitor computer having means for determining speed, acceleration, location and separation distance of vehicles utilizing the rail system; and a rail system control computer in operable communication with the rail system monitor computer, the rail system control computer having means for adjusting speed of the vehicles and separation distance of the vehicles on the rail system responsive to the information from the rail system control computer.

4. The personal transportation rail system according to claim 3, further comprising:

a vehicle selected from the group consisting of above rail pod vehicle and below rail suspended pod vehicle, the vehicle being adapted for travel on the personal transportation rail system; and the vehicle including front and rear rail engagement wheels, the rail engagement wheels being under processor control and selectively engaging first-gauge and second-gauge rails responsive to commands sent from the rail system control computer.

5. The personal transportation rail system according to claim 4, further comprising: modifications to the rail vehicle which enable the vehicle to be a dual-mode pod that enters at special street-level entry/exit stations; and common infrastructure that combines the personal transportation rail system with a bimodal guideway system for inter-urban transportation.

6. The personal transportation rail system according to claim 4, further comprising means for controlling the rail engagement wheels to selectively engage the third-gauge rails responsive to commands sent from the rail system control computer.

7. The personal transportation rail system according to claim 6, further comprising means to control the front engagement wheels to engage the second-gauge rails and the rear engagement wheels to engage the third-gauge rails during ascent to the system guideway station.

8. The personal transportation rail system according to claim 7, further comprising means for controlling the front engagement wheels to engage the third-gauge rails and the rear engagement wheels to engage the second-gauge rails during descent from the system guideway station.

9. The personal transportation rail system according to claim 8, wherein wheel engaging rail members of the first, second and third-gauge rail pairs are cylindrically tubular.

10. The personal transportation rail system according to claim 9, wherein the rail engagement wheels include flanges adapted for fitting outer cylindrical contours of the cylindrically tubular rail members.

11. A personal transportation rail (PTR) system, comprising:

a system guideway station;

a first-gauge pair of rails and a second-gauge pair of rails, the rail pairs forming portions of a guideway transitioning through the system guideway station, the rail pairs defining an elevated throughway portion having the same grade in advance of the system guideway station, the second-gauge rail pair having an ascending grade guideway station entry portion ascending to and leveling off at the system guideway station;

support columns providing grading of at least one of the rail pairs above ground level;

a descending grade guideway station exit portion of the second-gauge rail pair descending from the system guideway station to a grade level of, and leveling off parallel to, the first-gauge rail pair beyond the system guideway station;

a third-gauge rail pair having an ascending grade guideway station entry portion ascending to and leveling off at the system guideway station, the entry portion having an ascent slope start linearly displaced in advance of an ascent slope start of the second-gauge rail pair; whereby a rail vehicle engaging both the second-gauge ascending and the third-gauge ascending guideway station entry rail pair portions remains pitch neutral as the rail vehicle ascends to the guideway station; and wherein the PTR system may be integrated with a bimodal guideway system for inter-urban transportation.

12. The personal transportation rail system according to claim 11, further comprising:

a rail system monitor computer having means for determining speed, acceleration, location and separation distance of vehicles utilizing the rail system; and a rail system control computer in operable communication with the rail system monitor computer, the rail system control computer having means for adjusting speed of the vehicles and separation distance of the vehicles on the rail system responsive to the information from the rail system control computer.

13. The personal transportation rail system according to claim 12, further comprising:

a vehicle selected from the group consisting of above rail pod vehicle and below rail suspended pod vehicle, the vehicle being adapted for travel on the personal transportation rail system; and the vehicle including front and rear rail engagement wheels.

14. The personal transportation rail system according to claim 13, further comprising:

modifications to the rail vehicle which enable the vehicle to be a dual-mode pod that enters at special street-level entry/exit stations; and common infrastructure that combines the personal transportation rail system with a bimodal guideway system for inter-urban transportation.

15. The personal transportation rail system according to claim 13, wherein said rail system control computer further comprises:

means for controlling the rail engagement wheels to selectively engage the first-gauge and second-gauge rails; and means for controlling the rail engagement wheels to engage the second-gauge rails in advance of the system guideway station, the vehicle being guided to travel into the system guideway station and to travel into the rail system beyond the system guideway station by engaging the second-gauge rails.

16. The personal transportation rail system according to claim 15, wherein wheel engaging rail members of the first and second-gauge rail pairs are cylindrically tubular.

17. The personal transportation rail system according to claim 16, wherein the rail engagement wheels include flanges adapted for fitting outer cylindrical contours of the cylindrically tubular rail members.

* * * * *